United States Patent [19]

Kato et al.

[11] 4,281,623

[45] Aug. 4, 1981

[54] SHEET STRIPPING MEMBERS FOR FIXING DEVICE FOR FIXING IMAGES OF AN ORIGINAL DOCUMENT ON SHEETS OF COPY MATERIALS

[75] Inventors: Tutomu Kato, Yamatokoriyama; Susumu Houjyo, Kashihara, both of Japan

[73] Assignee: Sharp Kabushiki Kaisha, Osaka, Japan

[21] Appl. No.: 891,639

[22] Filed: Mar. 30, 1978

[30] Foreign Application Priority Data

Apr. 1, 1977 [JP] Japan ..... 52-41182[U]
Apr. 1, 1977 [JP] Japan ..... 52-41183[U]

[51] Int. Cl.[3] ..... B05C 11/00; B30B 3/04

[52] U.S. Cl. ..... 118/668; 100/174; 100/45; 118/60; 118/245; 118/675; 118/676; 219/216; 242/81; 355/3 R; 355/3 FU; 355/14 TR; 430/98; 430/99; 430/124; 432/60

[58] Field of Search ..... 427/22; 118/60, 4, 245, 118/1-3, 668; 355/3 FU, 14, 3 R; 432/60; 219/216; 242/81; 430/98, 99, 124; 100/174

[56] References Cited

U.S. PATENT DOCUMENTS

| | | | |
|---|---|---|---|
| 3,608,515 | 9/1971 | Tobias | 118/2 |
| 3,704,662 | 12/1972 | Johnson et al. | 118/247 |
| 3,846,151 | 11/1974 | Roteman et al. | 427/361 |
| 3,992,000 | 11/1976 | Martin | 118/245 |
| 4,065,120 | 12/1977 | Imaizumi et al. | 118/245 X |

*Primary Examiner*—Bernard D. Pianalto
*Attorney, Agent, or Firm*—Birch, Stewart, Kolasch & Birch

[57] ABSTRACT

A couple of copy sheet stripping members are provided for scraping away a copy sheet adhered strictly to one of two rollers which are driven to fix images of an original document on the copy sheet in pressure engagement. At least one of the copy sheet stripping members is secured removably from the roller while the copy sheet is not transferred out of the rollers. The copy sheet stripping member becomes pressed against the roller in accordance with the transferring of the copy sheet which is detected by a sensing means. The copy sheet stripping member is free of residue attached on the roller because the period of time where the engagement between the roller and the copy sheet stripping member is kept is very short. The other copy sheet stripping member can be further disposed to assure both the scrape of the copy sheet and the removal of the residue on the roller, the copy sheet stripping member being continuously pressed against the roller.

12 Claims, 2 Drawing Figures

SHEET STRIPPING MEMBERS FOR FIXING DEVICE FOR FIXING IMAGES OF AN ORIGINAL DOCUMENT ON SHEETS OF COPY MATERIALS

BACKGROUND OF THE INVENTION

The present invention relates generally to a copy sheet stripping mechanism for use in a copier and, more particularly, to devices in such copy sheet stripping mechanism for stripping a copy sheet from one of two rollers which are driven to fix images of an original document on the copy sheet.

A couple of prior art copy sheet stripping members are positioned to engage with respective roller under pressure, which serve to scrape the copy sheet off from one of the rollers. However, such positioned copy sheet stripping members have the inevitable defect that residue attached on the rollers is also stripped by the copy sheet stripping members to thereby damage a pointed end of the copy sheet stripping members. Subsequently, the scraped residue makes the copy sheet dirty. An example of such prior art copy sheet stripping members was disclosed in J. ROTEMAN ET AL U.S. Pat. No. 3,846,151 entitled "FIXING DEVICE" issued on Nov. 5, 1974.

Therefore, it is preferable that the copy sheet stripping mechanism have the copy sheet stripping members thereof contact the roller no more than necessary so as to prevent pollution or damage to the copy sheet caused by scrapping the residue attached to the roller and allowing the residue to build up on the copy sheet stripping members.

OBJECTS AND SUMMARY OF THE INVENTION

Accordingly, an object of the present invention is to provide a new and improved device for scraping a copy sheet off from one of two rollers which are driven to fix images of an original document of the copy sheet in pressure engagement thereof.

Another object of the present invention is to provide a new and improved device for stripping a copy sheet from one of two rollers which are driven to fix images of an original document on the copy sheet in pressure engagement thereof. The device permits the copy sheet to be stripped off from one of the rollers without unnecessarily scraping residue attached on the roller.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, at least one of copy sheet stripping members is positioned to be removable from a roller relevant thereto in the absence of a copy sheet. A copy sheet sensing signal is developed by a sensing means comprising a microswitch which detects the transfer of the copy sheet, the sensing means being positioned opposite to the copy sheet stripping member regarding the roller. The copy sheet sensing signal controls the copy sheet stripping member to press the copy sheet stripping member toward the roller when the sensing means detects the presence of the copy sheet.

The copy sheet stripping member is spaced away from the roller when the other sensing means detects the separation of the copy sheet from the roller.

In another embodiment of the present invention, another device can be placed to secure the detachment of the copy sheet and continuously clean up the roller by removing residue attached on the roller. The device is continuously pressed toward the roller irrespective of the traveling copy sheet. The device, another copy sheet stripping member, can scrape the copy sheet off the roller even though the above copy sheet stripping members fail to pick off the copy sheet from the rollers.

BRIEF DESCRIPTION OF THE DRAWING

Other objects and novel features of the present invention are set forth in the appended claims. The present invention, as to its organization and its mode of operation, will best be understood from a consideration of the following detailed description of the preferred embodiments taken in connection with the accompanying drawings, wherein:

DETAILED DESCRIPTION OF THE PREFERRED EMBODIMENTS

Figure 1:
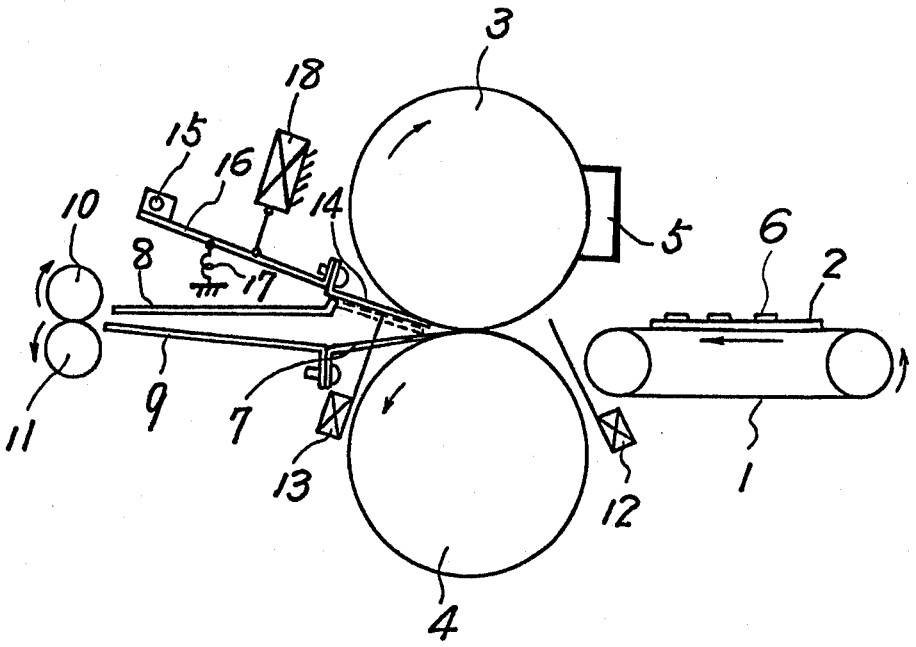
FIGS. 1 and 2 are side views of copy sheet stripping mechanisms, for use in copiers, for fixing images of an original document on a copy sheet according to the present invention.

FIG. 1 shows a copy sheet stripping mechanism included within an apparatus for fixing images of an original document on a copy sheet according to the present invention. The copy sheet stripping mechanism mainly comprises a pair of sensing means 12, 13, a pair of copy sheet stripping members 7, 14, and two rollers 3, 4.

The apparatus further includes a belt 1, a copy sheet 2, a cleaning pad 5, two guide frames 8, 9, a couple of sending rollers 10, 11, a bearing 15, a bar 16, a spring 17, and a solenoid 18. The belt 1 is provided for transferring the copy sheet 2 thereon. Toner powder 6 is adhered to the surface of the copy sheet 2 and corresponds to images of an original document. The copy sheet 2 is passed between the two rollers 3, 4 in pressure engagement to fix the toner powder 6 strictly on the copy sheet 2. The roller 3 follows in the rotation thereof the other roller 4 which is driven by a driving system (not shown).

The toner powder 6 has a tendency to release from the surface of the copy sheet 2 and to adhere to the surface of the two rollers 3, 4 in pressure engagement, a problem that is well known as "offset". It is well known in the prior art to apply a releasing agent such as a silicone oil, to the surface of the rollers 3, 4, for example, the roller 3 in contact with copy sheet 2, to prevent the offset of the toner powder 6. The releasing agent is provided by the cleaning pad 5 which has impregnated within it the releasing agent.

The sensing means 12, 13 are provided for detecting the transfer of the copy sheet 2, each of the sensing means comprising a microswitch, a photodetector, etc. The copy sheet stripping members 7, 14 are provided for scraping away the copy sheet 2 adhered to one of the two rollers 3, 4, each of the copy sheet stripping members 7, 14 having a rectangular shape although not shown in the drawings. The copy sheet stripping member 7 is engaged constantly with the guide frame 9 and the other copy sheet stripping member 14 may become in contact with the guide frame 8.

The copy sheet stripping member 14 is strictly engaged to the bar 16 at the end thereof opposite to the end pressed against the roller 3. The bar 16 is rotatably secured around the bearing 15, and is movable in response to both the spring 17 and the solenoid 18. The copy sheet stripping member 14 contacts with the guide frame 8 at the position shown in dotted line in accordance with the activation of the spring 17 unless the solenoid 18 is energized. The solenoid 18 when energized attracts the bar 16 and, therefore, the copy sheet stripping member 14 becomes disposed to the position where the copy sheet stripping member is pressed against the roller 3 to scrape away the copy sheet 2 adhered to the roller 3 as shown in the solid line.

Figure 2:
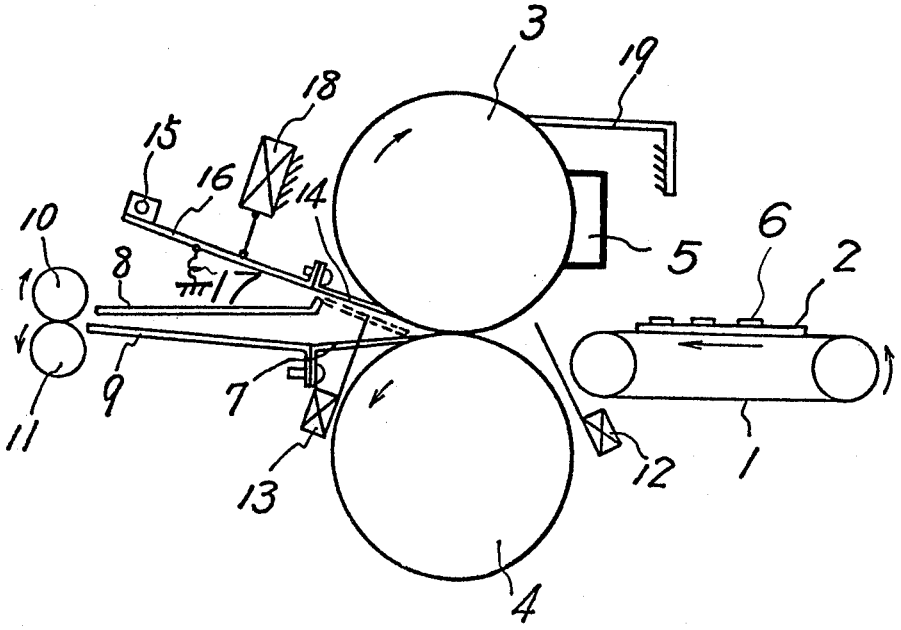

Under the above construction, the copy sheet 2 is transferred to the rollers 3, 4 by the belt 1 so that the toner powder 6 adhered to the surface of the copy sheet 2 corresponds to the images of the original document. In front of the rollers 3, 4 the copy sheet 2 contacts a feeler of the sensing means 12 to thereby detect the transfer of the copy sheet 2. The solenoid 18 is energized to press the copy sheet stripping member 14 against the roller 3 in unison with the detection by the sensing means 12. The copy sheet 2 is between and pulled off the rollers 3, 4 which are in pressure engagement. The copy sheet stripping members 7, 14 function to scrape away the copy sheet 2 adhered to one of the rollers 3, 4. When the copy sheet 2 is detected by the sensing means 13, the solenoid 18 is deenergized to return the copy sheet stripping member 14 to the guide frame 8. Subsequently, the copy sheet 2 is passed between the two sending rollers 10, 11. FIG. 2 illustrates the copy sheet stripping mechanism of another embodiment of the present invention, wherein another copy sheet stripping member 19 is further provided for scraping away the copy sheet 2 which is not stripped off by the copy sheet stripping member 14 and picking off residue adhered to the roller 3. Like elements corresponding to those of FIG. 1 are illustrated by like numerals.

If the solenoid 18 is not energized due to the failure of the sensing means 12, 13, the copy sheet 2 which is adhered to the roller 3 is not scraped by the copy sheet stripping member 14. The present copy sheet stripping member 19 can scrape such copy sheet 2 off the roller, the copy sheet stripping member 19 being continuously pressed toward the roller 3 and positioned after the copy sheet stripping member 14 in the direction of rotation of the roller 3. Furthermore, the residue adhered to the roller 3 is stripped by the copy sheet stripping member 19, the residue comprising the toner powder 6 or the like. The residue can be sustained by the copy sheet stripping member 19 and the copy sheet stripping member 19 is positioned so that the scraped residue 6 does not drop on the copy sheet 2.

The copy sheet stripping member 13 can be removably secured as well as the copy sheet stripping member 14 although this is not shown in the above embodiments.

While only certain embodiments of the present invention have been described, it will be apparent to those skilled in the art that various changes and modifications may be made therein without departing from the spirit and scope of the invention as claimed.

What is claimed is:

1. In a copy sheet stripping device within a copier, said copier including a pair of rollers for fixing images of an original document on a copy material by pressure engagement between said rollers, the improvement comprising:

means for moving the copy sheet stripping device into engagement with one of said pair of rollers to scrape away the copy material from that roller in synchronization with the approach of the copy material toward the rollers, and for moving the copy sheet stripping device away from that roller in synchronization with the separation of the copy material from the rollers.

2. The copy sheet stripping device according to claim 1 further comprising:

stripping means for continuously cleaning one of said rollers so as to scrape away the copy material adhered to that roller and pick off residue adhered to that roller.

3. A copy sheet stripping device within an instrument for fixing images of an original document on a copy material by using a pair of rollers in pressure engagement, comprising:

first means for detecting the approach of the copy material toward said pair of rollers and providing a first detection signal in response to the approach;

second means for sensing the exit of the copy material from said pair of rollers and providing a second detection signal in response thereto;

copy sheet stripping means for stripping the copy material from one of said pair of rollers; and energization means which is activated by the first detection signal to move the copy sheet stripping member into engagement with that roller and, subsequently activated by the second detection signal to move the copy sheet stripping member away from that roller.

4. The copy sheet stripping device according to claim 3, wherein the energization means comprises a spring means which is continuously energized so as to force the copy sheet stripping member into disengagement with said one of said pair of rollers and a solenoid means which is energized to position the copy sheet stripping member in engagement with that roller and disenergized to move the copy sheet stripping member away from that roller.

5. The copy sheet stripping device according to claim 3, wherein each of said first and second means comprises a microswitch.

6. The copy sheet stripping device according to claim 3, wherein each of said first and second means comprises a photo detection system.

7. A device for separating sheets from a moving member having a width transverse to the direction of travel, comprising:

stripping means for separating said sheet from said moving member, said stripping means being rigid and having an edge capable of engaging the moving member;

means for sensing when said sheet is in close proximity to said stripping means; and means responsive to said sensing means for moving said stripping means into engagement with said moving member only when said sheet is detected by said sensing means.

8. The device of claim 7 wherein said moving means comprises:

solenoid means for moving said stripping means into engagement with said moving member in response to the detection of said sheet by said sensing means; and resilient means for maintaining a bias force on said stripping means for retaining said stripping means into disengagement from said moving member when said solenoid means is not activated.

9. The device of claim 8 wherein said means for sensing comprises at least one microswitch.

10. The device of claim 9 wherein said means for sensing comprises at least one photodetector.

11. The device of any of claims 7-10 wherein said moving member is one of a pair of rollers for fixing images of an original document on the sheet in a copier.

12. The device of claim 11 further comprising: fixed stripping means for maintaining said one of a pair of rollers clean by continuously removing any residue from that roller.

* * * * *